US010446025B2

(12) United States Patent
Yu

(10) Patent No.: US 10,446,025 B2
(45) Date of Patent: Oct. 15, 2019

(54) TRAFFIC LIGHT CONTROL SYSTEM

(71) Applicant: Kuo-Chen Yu, Chiayi (TW)

(72) Inventor: Kuo-Chen Yu, Chiayi (TW)

( * ) Notice: Subject to any disclaimer, the term of this patent is extended or adjusted under 35 U.S.C. 154(b) by 0 days.

(21) Appl. No.: 16/172,992

(22) Filed: Oct. 29, 2018

(65) Prior Publication Data

US 2019/0130738 A1 May 2, 2019

(51) Int. Cl.

| | |
|---|---|
| ***G08G 1/087*** | (2006.01) |
| ***G08G 1/095*** | (2006.01) |
| ***G08G 1/056*** | (2006.01) |
| ***G08G 1/16*** | (2006.01) |
| ***G08G 1/081*** | (2006.01) |

(52) U.S. Cl.

CPC ..... *G08G 1/087* (2013.01); *G08G 1/056* (2013.01); *G08G 1/081* (2013.01); *G08G 1/095* (2013.01); *G08G 1/162* (2013.01)

(58) Field of Classification Search

CPC ..... G08G 1/087; G08G 1/095; G08G 1/056; G08G 1/162; G08G 1/081; G08G 1/0965

USPC ..... 340/902, 906

See application file for complete search history.

(56) References Cited

U.S. PATENT DOCUMENTS 9,805,595 B1 * 10/2017 Liebinger Portela ..... G08G 1/0145
2004/0008127 A1 * 1/2004 Manavi ..... G08G 1/087 340/907
2005/0231385 A1 * 10/2005 Haase ..... G06Q 30/0265 340/905
2006/0265294 A1 * 11/2006 de Sylva ..... G06Q 10/087 705/28
2010/0141477 A1 * 6/2010 Lim ..... G08G 1/081 340/906
2012/0112928 A1 * 5/2012 Nishimura ..... G08G 1/07 340/909
2014/0118168 A1 * 5/2014 Lee ..... G08G 1/096725 340/905
2015/0243165 A1 * 8/2015 Elsheemy ..... B60R 25/00 340/906
2017/0092126 A1 * 3/2017 Oshida ..... G08G 1/096791
2019/0096242 A1 * 3/2019 Gao ..... G08G 1/08

* cited by examiner

*Primary Examiner* — Ojiako K Nwugo

(74) *Attorney, Agent, or Firm* — Thomas|Horstemeyer, LLP

(57) ABSTRACT

A traffic light control system includes a first traffic light apparatus and multiple second traffic light apparatuses for displaying a direction pattern indicating intended movement of an emergency vehicle about to pass through an intersection, and a controller storing direction patterns each indicating a direction to take and a specific movement manner of the emergency vehicle. In response to a direction signal corresponding to one of the direction patterns, the controller controls the first traffic light apparatus to display the one direction pattern, and controls each of the second traffic light apparatuses to display a corresponding oriented version of said one direction pattern based on a location of the second traffic light apparatus.

12 Claims, 8 Drawing Sheets

TRAFFIC LIGHT CONTROL SYSTEM

CROSS-REFERENCE TO RELATED APPLICATION

This application claims priority of Taiwanese Patent Application No. 106137619, filed on Oct. 31, 2017.

FIELD

The disclosure relates to a traffic control system, and more particularly to a traffic control system for indicating a direction to take of an emergency vehicle.

BACKGROUND

Research shows that close to 60 percent of traffic accidents in Taiwan occur at a road intersection. When an emergency vehicle (e.g., an ambulance, a fire engine, a police car, etc.) is on emergency duty, warning is typically employed, such as an audible warning (e.g., siren) and/or an active visual warning (e.g., flashing light) in order to alert other road users that the emergency vehicle is approaching. However, since the emergency vehicle typically does not follow the traffic rules, with the other road users not knowing a driving direction of the emergency vehicle, accidents tend to happen.

SUMMARY

One object of the disclosure is to provide a traffic light control system that is capable of notifying vehicles and pedestrians on each of a plurality of road segments of an intersection of an approaching emergency vehicle.

According to one embodiment of the disclosure, the traffic light control system includes a set of traffic light apparatuses and a controller.

The set of traffic light apparatuses is to be mounted respectively at a plurality of road segments of an intersection, and includes a first traffic light apparatus and a plurality of second traffic light apparatuses. Each of the traffic light apparatuses is for displaying a direction pattern to indicate a direction an emergency vehicle about to pass through the intersection is to move.

The controller is coupled to the first traffic light apparatus and the second traffic light apparatuses and storing a number of direction patterns. Each of the direction patterns indicates a direction to take and a specific movement manner of the emergency vehicle. The specific movement manner may be one of going straight, taking a turn and taking a U-turn.

The controller is programmed to, in response to receipt of a direction signal corresponding to one of the direction patterns, control the first traffic light apparatus to display the one of the direction patterns in a dynamic manner, and control each of the second traffic light apparatuses to display a correspondingly oriented version of the one of the direction patterns in a dynamic manner based on a location of each of the second traffic light apparatuses relative to the first traffic light apparatus.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
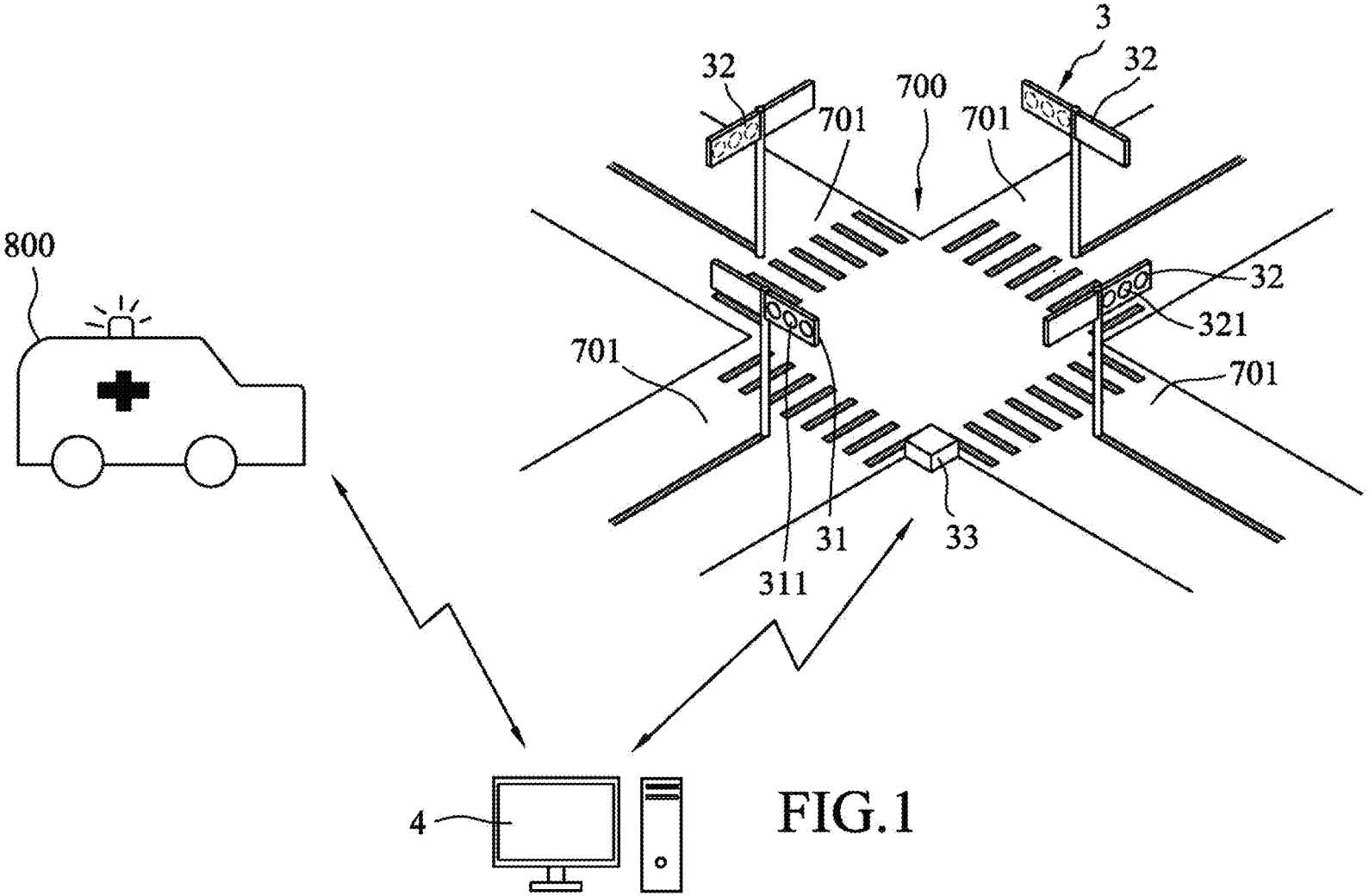
FIG. 1 illustrates a traffic light control system, according to one embodiment of the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

FIG. 1 illustrates a traffic light control system according to one embodiment of the disclosure. The traffic light control system is to be implemented at a road intersection (hereinafter referred to simply as "intersection") 700 that includes a plurality of road segments 701. In the embodiment of FIG. 1, the intersection 700 includes four road segments 701, i.e., the intersection 700 is a 4-way intersection.

The traffic light control system includes a set 3 of traffic light apparatuses to be mounted respectively at the plurality of road segments 701 of the intersection 700, a controller 33 that is coupled to the set 3 of traffic light apparatuses, and a control host 4 that communicates with the controller 33. In this embodiment, four traffic light apparatuses are present in the set 3.

The set 3 of traffic light apparatuses includes a first traffic light apparatus 31, and a plurality of second traffic light apparatuses 32.

Each of the first and second traffic light apparatuses 31, 32 may be embodied using a standard three-aspect light device that has three lighting devices capable of displaying at least three standard traffic signals (e.g., green, yellow, red), respectively, and is for displaying a direction pattern for indicating a direction of an emergency vehicle 800 about to pass through the intersection 700. In this embodiment, the lighting device (numbered 311, 321 in FIG. 1) used for displaying the yellow traffic signal may be employed to display the direction pattern. In this configuration, the direction pattern may be displayed simultaneously with the normal green/red lights without negatively impacting the display functionality of the traffic light apparatuses 31, 32.

In the disclosure, the term "emergency vehicle" refers to a vehicle that is on emergency duty (e.g., an ambulance, a fire engine, a police car, etc., that is on duty), and should typically be yielded to on the road. In embodiments, the emergency vehicle 800 is equipped with a positioning device (not depicted in the drawings) that is capable of obtaining a set of geographical coordinates indicating a current position of the emergency vehicle 800, an emergency warning unit that is for generating a warning (e.g., an audio warning, a visual warning (such as flashing light), etc.) when the emergency vehicle 800 is on emergency duty (e.g., transporting a patient, moving to a fire site, etc.), and a signal transmitter (not depicted in the drawings) that is configured to transmit a turning signal to the control host 4 when a turn-signal light (i.e., a direction indicator) of the emergency vehicle 800 is activated. It is noted that the set of geographical coordinates and the turning signal may be transmitted using a wireless transmission technique via an antenna (not depicted in the drawings) equipped on the emergency vehicle 800.

Figure 2:
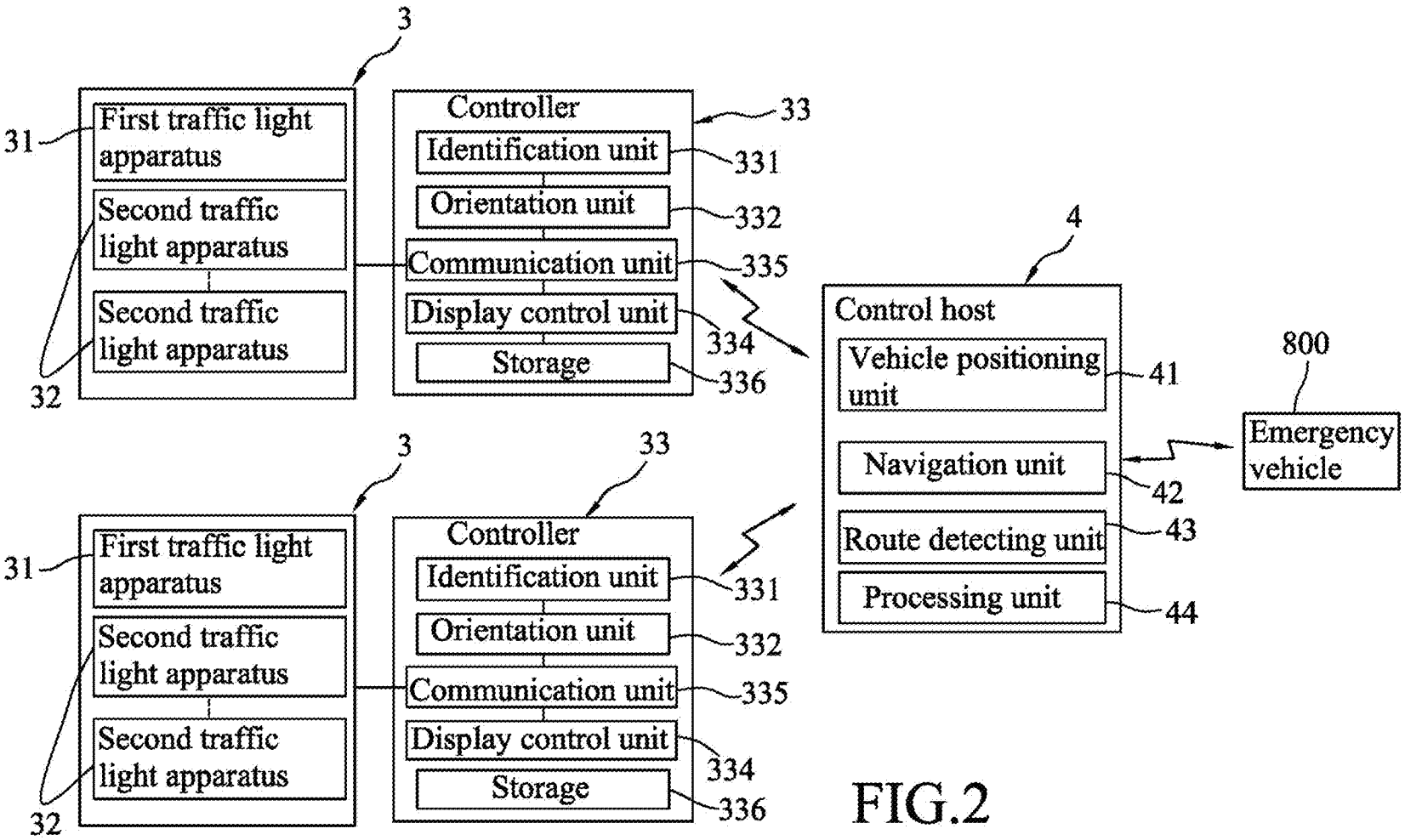
FIG. 2 is a block diagram illustrating the components of the traffic light control system, according to one embodiment of the disclosure

FIG. 2 is a block diagram illustrating the components of the traffic light control system, according to one embodiment of the disclosure.

The controller 33 includes storage 336, a communication unit 335, an identification unit 331, an orientation unit 332 and a display control unit 334.

The controller 33 may include, but not limited to, a single core processor, a multi-core processor, a dual-core mobile processor, a microprocessor, a microcontroller, a digital signal processor (DSP), a field-programmable gate array (FPGA), an application specific integrated circuit (ASIC), a radio-frequency integrated circuit (RFIC), etc., in order to perform the operations described below.

The storage 336 may be embodied using a physical storage module such as a hard disk drive, a solid-state drive, a random access memory (RAM), flash memory, etc., and stores a number of direction patterns therein. Each of the direction patterns indicates a direction to take and a specific movement manner of the emergency vehicle 800. In this embodiment, the specific movement manner may be one of going straight, taking a turn and taking a U-turn.

The communication unit 335 may include a short-range wireless communicating module supporting a short-range wireless communication network using a wireless technology of Bluetooth® and/or Wi-Fi, etc., and a mobile communicating module supporting telecommunication using Long-Term Evolution (LTE), the third generation (3G) and/or fourth generation (4G) of wireless mobile telecommunications technology, and/or the like, and is configured to communicate with the control host 4 for receiving data therefrom, and is configured to communicate with the traffic light apparatuses 31, 32 for transmitting data thereto.

Specifically, the control host 4 may transmit a direction signal corresponding to one of the direction patterns to the communication unit 335 of the controller 33.

The identification unit 331 is programmed to process the direction signal and to identify the one of the direction patterns to which the direction signal corresponds.

The orientation unit 332 is programmed to determine the location of each of the second traffic light apparatuses 32 relative to the first traffic light apparatus 31, and to generate a plurality of specifically oriented direction patterns 333 (see FIG. 3) respectively for the second traffic light apparatuses 32 by turning the one of the direction patterns 330 (see FIG. 3) based on the locations of the second traffic light apparatuses 32. It is noted that each of specifically oriented direction patterns 333 has a same shape as the corresponding direction pattern 330.

The display control unit 334 is for controlling the communication unit 335 to transmit the one of the direction patterns 330 to the first traffic light apparatus 31, and to transmit the specifically oriented direction patterns 333 respectively to the second traffic light apparatuses 32. As such, the first traffic light apparatus 31 is controlled to display the one of the direction patterns 330 in a dynamic manner, and each of the second traffic light apparatuses 32 is controlled to display an oriented version of the one of the direction patterns 330 in a dynamic manner.

Figure 3:
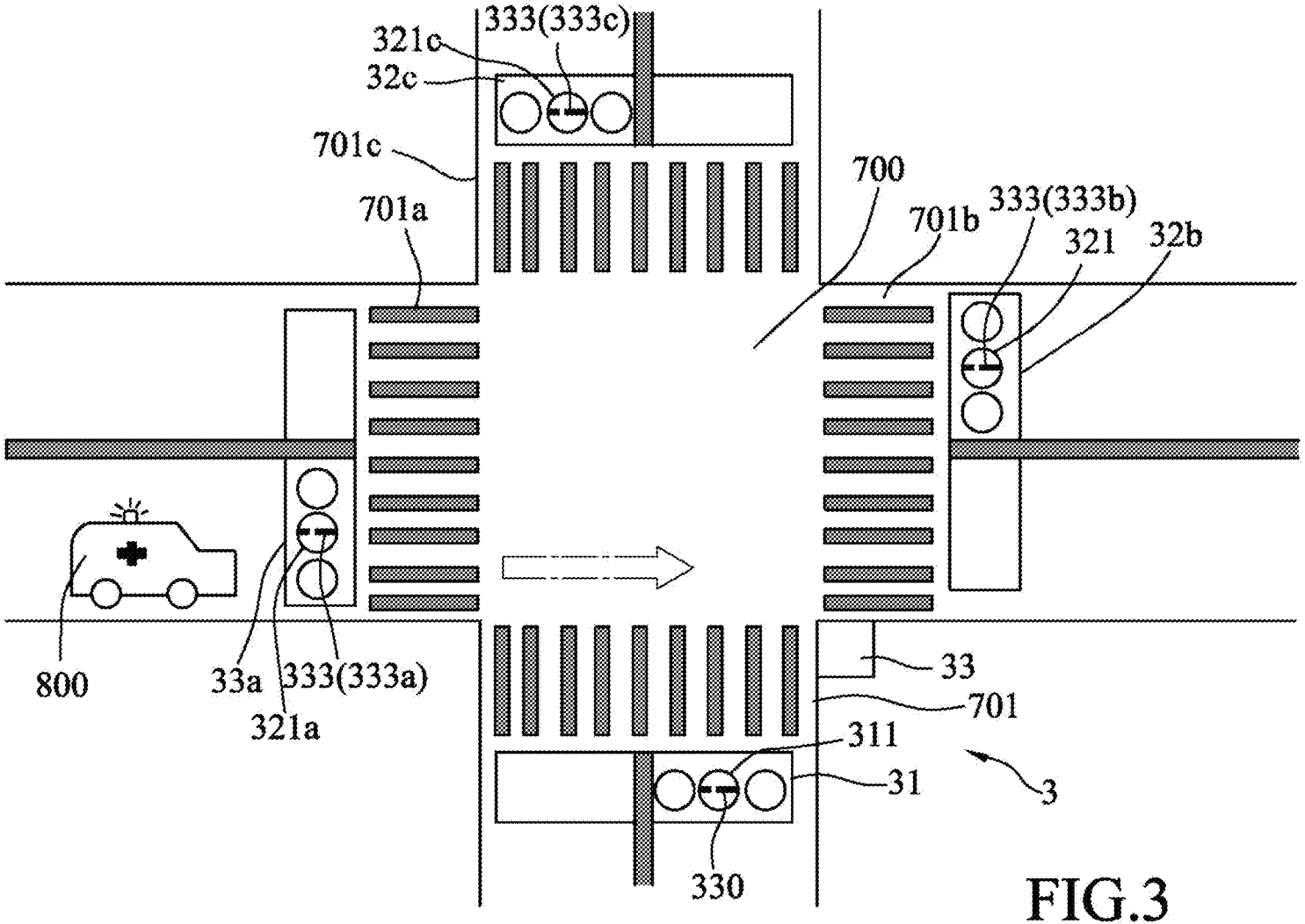
FIG. 3 illustrates the traffic light control system displaying an exemplary direction pattern that directs the emergency vehicle to go forward.

FIG. 3 illustrates the traffic light control system displaying an exemplary direction pattern 330 that directs the emergency vehicle 800, which is coming from a left side road segment 701*a* of the intersection 700, to go forward (i.e., along the arrow in FIG. 3). As a result, the direction pattern 330 to be displayed by the first traffic light apparatus 31 indicates a line segment in a dynamic manner that seems to "move" from left to right from the perspective of a road user (e.g., a vehicle driver and a pedestrian) facing the first traffic light apparatus 31, so as to indicate to the road user that the emergency vehicle 800 is to move from left to right.

Figure 4:
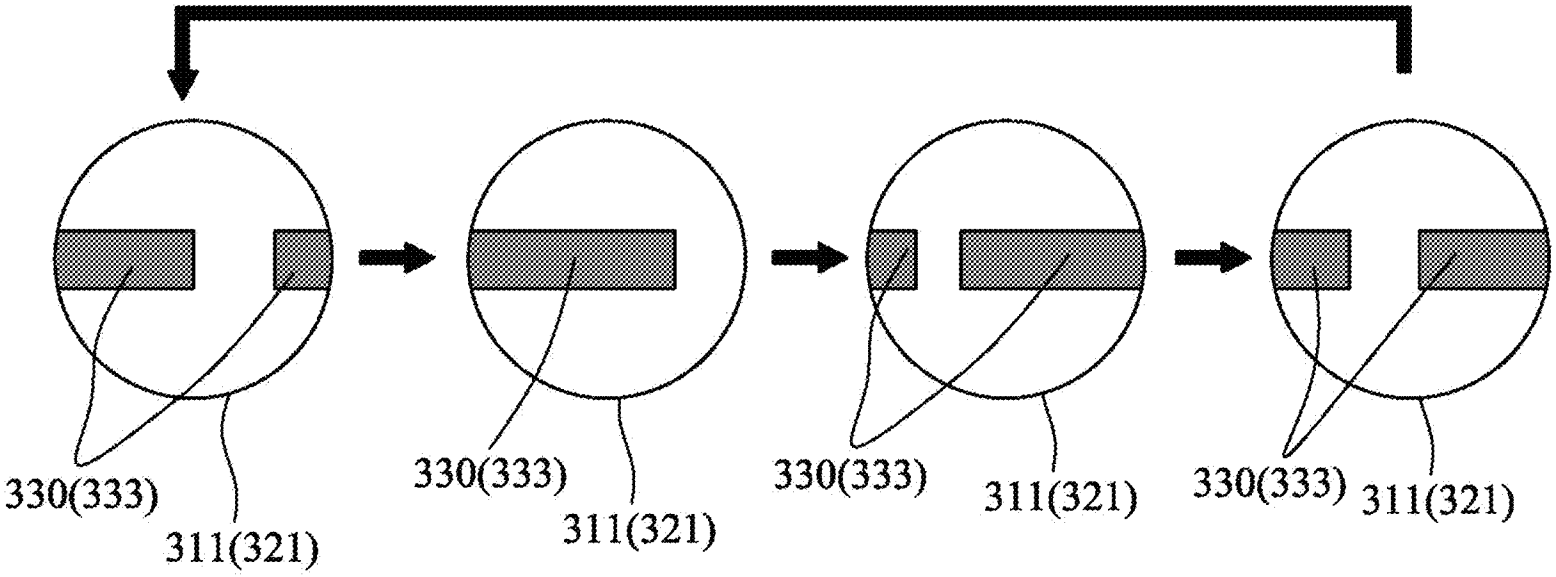
FIG. 4 illustrates an exemplary dynamic manner in which the direction pattern of FIG. 3 is to be displayed by the traffic light control system.

Referring to FIG. 4, in this embodiment, each of the direction patterns 330 includes a line segment that extends along the direction to take. Each of the traffic light apparatuses 31, 32 is programmed to display the direction pattern 330 or the specifically oriented direction pattern 333 using the yellow lighting device 311, 321 in the dynamic manner such that the direction pattern 300 or the specifically oriented direction pattern 333 is seen as moving along the direction to take repeatedly.

That is to say, referring back to FIG. 3, for one of the second traffic light apparatuses 32*a* that is on the left side road segment 701*a* of the intersection 700, the specifically oriented direction pattern 333*a* to be displayed by the second traffic light apparatus 32*a* is generated by turning the direction pattern 330 counterclockwise by 90 degrees. As a result, the second traffic light apparatus 32*a* displays the specifically oriented direction pattern 333*a* that indicates a line segment in a dynamic manner that seems to "move" upwardly (i.e., indicating moving forward) from the perspective of the emergency vehicle 800, so as to indicate that the emergency vehicle 800 is to move forwardly.

Similarly, for one of the second traffic light apparatuses 32*b* that is on the right side road segment 701*b* of the intersection 700, the specifically oriented direction pattern 333*b* to be displayed thereby is generated by turning the direct ion pattern 330 clockwise by 90 degrees. As a result, the specifically oriented direction pattern 333*b* displayed by the second traffic light apparatus 32*b* indicates a line segment in a dynamic manner that seems to "move" downwardly (i.e., indicating moving backward) from the perspective of the road users facing the second traffic light apparatus 32*b* that is on the right side road segment 701*b* of the intersection 700, so as to indicate to these road users that the emergency vehicle 800 is to move toward the second traffic light apparatus 32*b*.

For one of the second traffic light apparatuses 32*c* that is opposite to the first traffic light apparatus 31, the specifically oriented direction pattern 333*c* to be displayed thereby is generated by turning the one of the direction patterns 330 by 180 degrees. As a result, the specifically oriented direction pattern 333*c* displayed by the corresponding second traffic light apparatus 32*c* indicates a line segment in a dynamic manner that seems to "move" from right to left from the perspective of the road users facing the second traffic light apparatus 32*c* that is right across from the first traffic light apparatus 31, so as to indicate to these road users that that the emergency vehicle 800 is to move from right to left.

Figure 5:
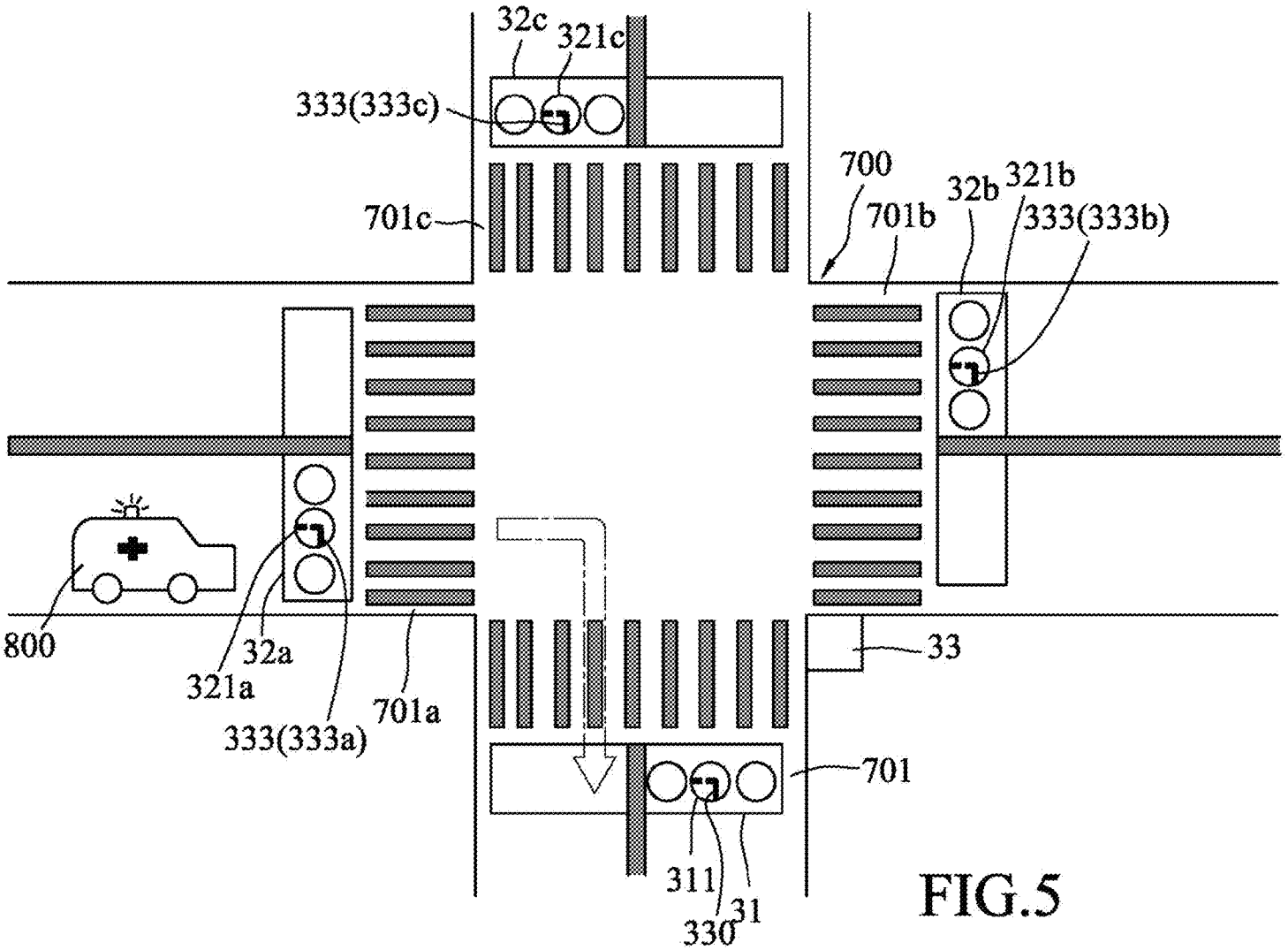
FIG. 5 illustrates the traffic light control system displaying an exemplary direction pattern that directs the emergency vehicle to take a right turn.
Figure 6:
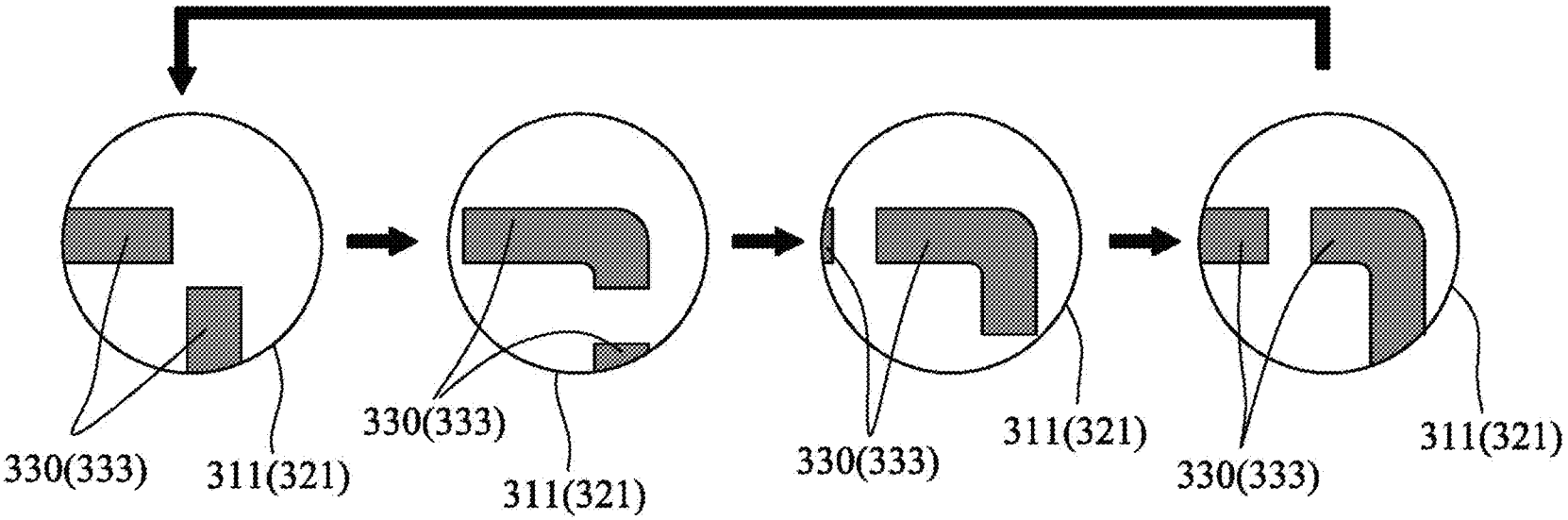
FIG. 6 illustrates an exemplary dynamic manner in which the direction pattern of FIG. 5 is to be displayed by the traffic light control system.

FIG. 5 illustrates an exemplary direction pattern 330 that indicates that the emergency vehicle 800 is coming from a left side road segment 701*a* of the intersection 700 and is about to make a right turn (i.e.; along the arrow in FIG. 5). As a result, the direction pattern 330 displayed by the first traffic light apparatus 31 indicates a line segment in a dynamic manner that seems to "move" from left to right and then "turn" downwardly (as seen in FIG. 6) from the perspective of road users facing the first traffic light apparatus 31, so as to indicate to these road users that the emergency vehicle 800 is to move from left to right and to make a right turn. It should be noted that a manner in which the specifically oriented direction pattern 333 is generated for each of the second traffic light apparatuses 32 may be similar to that described in FIGS. 3 and 4, and details thereof are omitted herein for the sake of brevity.

It is noted that in other embodiments, the intersection 700 may be other types with different numbers of road segments 701, and the generation of the specifically oriented direction patterns 333 may be done differently based on the type of the intersection 700. Additionally, the dynamic manner in which the direction pattern 330 and the specific oriented direction patterns 333 are displayed may be different from that as described in the above paragraphs and FIGS. 4 and 6.

Referring to FIG. 2, the control host 4 includes a vehicle positioning unit 41, a navigation unit 42, a route detecting unit 43 and a processing unit 44.

The vehicle positioning unit 41 stores an electronic map covering the intersection 700 and the road segments 701, and is configured to continuously receive the set of geographical coordinates of the emergency vehicle 800 for determining a current position of the emergency vehicle 800 on the electronic map.

The navigation unit 42 is configured to plot a route from the current position of the emergency vehicle 800 to a preset destination through the intersection 700, and to determine the direction to take when the emergency vehicle 800 passes through the intersection 700 based on the plotted route. In this embodiment, the preset destination may be a site of accident, a hospital, etc., and the plotting of the route may be done using a process that is known in the art.

The route detecting unit 43 is configured to receive the turning signal from the emergency vehicle 800 so as to determine a movement that the emergency vehicle 800 intends to make.

The processing unit 44 may include, but not limited to, a single core processor, a multi-core processor, a dual-core mobile processor, a microprocessor, a microcontroller, a digital signal processor (DSP), a field-programmable gate array (FPGA), an application specific integrated circuit (ASIC), a radio-frequency integrated circuit (RFIC), etc., in order to perform the operations described below.

The processing unit 44 is programmed to obtain the current position of the emergency vehicle 800 periodically from the vehicle positioning unit 41 so as to calculate a direction of movement and a moving speed of the emergency vehicle 800.

The processing unit 44 is further configured to determine a distance between the current position of the emergency vehicle 800 and the intersection 700 based on the electronic map stored in the vehicle positioning unit 41, and to calculate an estimated time of arrival based on the moving speed of the emergency vehicle 800 and the distance between the current position of the emergency vehicle 800 and the intersection 700.

The processing unit 44 is further configured to determine whether the movement which the emergency vehicle 800 intends to make as determined by the route detecting unit 43 is in compliance with the route plotted by the navigation unit 42 (i.e., whether the movement which the emergency vehicle 800 intends to make is the same as the direction to take determined by the navigation unit 42).

In one embodiment, the processing unit 44 is programmed to, when it is determined that the movement which the emergency vehicle 800 intends to make is in compliance with the route plotted by the navigation unit 42, generate the direction signal based on the direction of movement and the current position of the emergency vehicle 800 when it is determined that the estimated time of arrival is shorter than a predetermined threshold. Also, in generating the direction signal, the processing unit 44 incorporates the direction to take in the direction signal. Then, the processing unit 44 transmits the direction signal to the controller 33. In response, the controller 33 controls the first traffic light apparatus 31 to display the one of the direction patterns 330, and controls each of the second traffic light apparatuses 32 to display a correspondingly oriented version of the one of the direction patterns 333.

In another embodiment, the processing unit 44 is programmed to, when the processing unit 44 determines that the distance between the current position of the emergency vehicle 800 and the intersection 700 is shorter than a predetermined threshold, generate the direction signal based on the current position of the emergency vehicle 800 and transmit the direction signal to the controller 33.

The determination that the movement which the emergency vehicle 800 intends to make is not in compliance with the route plotted by the navigation unit 42 may be one of the following three distinct conditions.

A first condition involves that the direction to take (plotted by the navigation unit 42) is to go forward, but a turning signal is received, indicating that the emergency vehicle 800 intends to make a turn. A second condition involves that the direction to take is to turn to a specific direction, yet no turning signal is received, indicating that the emergency vehicle 800 intends to go forward. A third condition involves that the direction to take is to turn to a specific direction, and while a turning signal is received, the turning signal indicates that the emergency vehicle 800 intends to make a turn that is different from the direction to take (e.g., the route dictates a right turn while the turning signal indicates a left turn).

The processing unit 44 is programmed such that in any one of the above three conditions, prior to the emergency vehicle 800 passing through the intersection 700, the processing unit 44 is to generate the direction signal based on the movement of the emergency vehicle 800, so as to notify other vehicles and pedestrians passing through the intersection 700 of the movement of the emergency vehicle 800.

Figure 8:
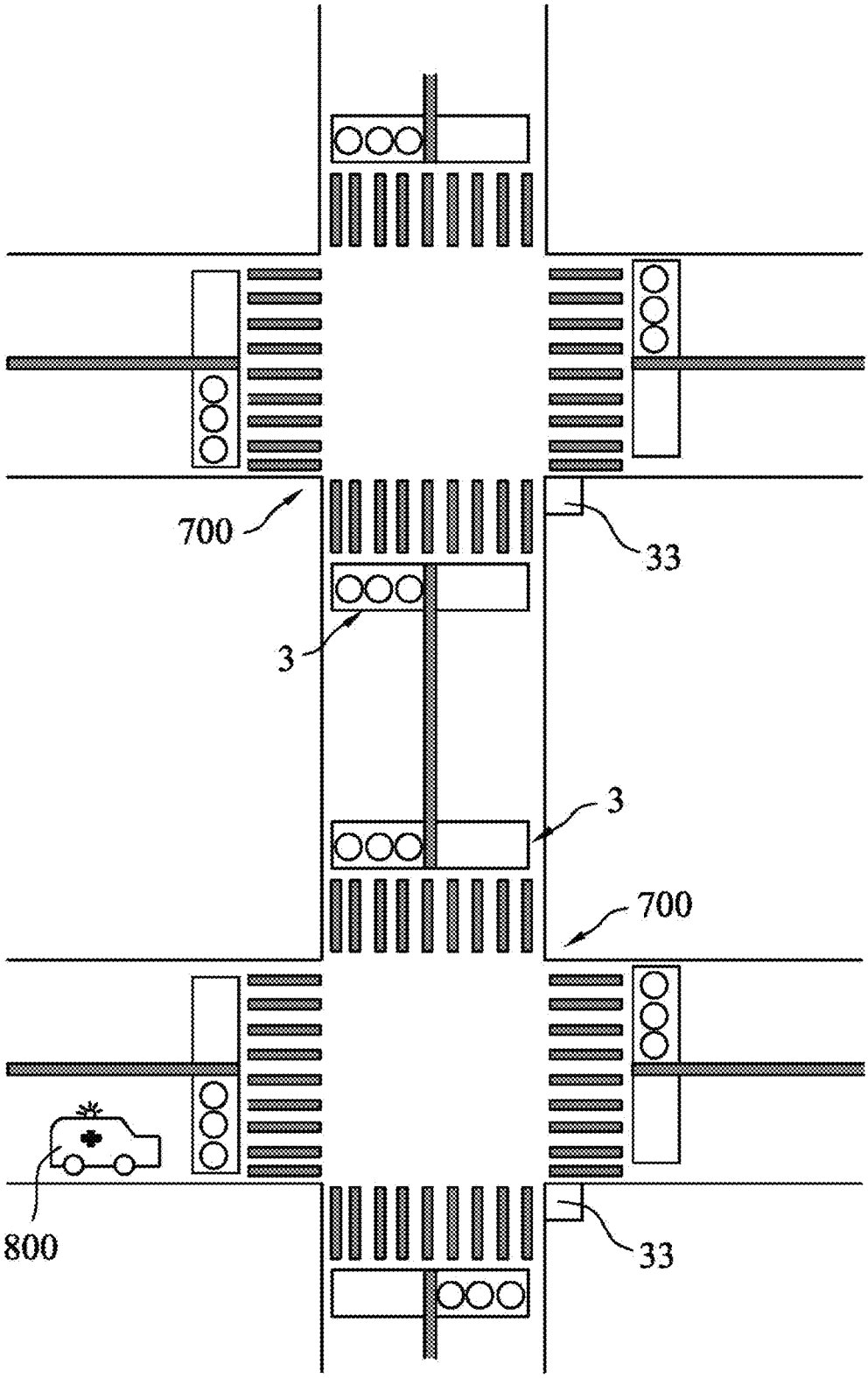
FIG. 8 illustrates a traffic light control system, installed in two separate intersections, according to one embodiment of the disclosure.

In one embodiment as illustrated in FIG. 8, the traffic light control system may include a plurality of sets 3 of the traffic light apparatuses and a plurality of the controllers 33 coupled respectively to the sets 3 of the traffic light apparatuses. Each set 3 of the traffic light apparatuses is to be mounted at a corresponding intersection 700. The control host 4 (see FIG. 1) is capable of communicating with the plurality of the controllers 33 and the emergency vehicle 800. In this embodiment, when the emergency warning unit of the emergency vehicle 800 is activated, a signal is transmitted to the control host 4 indicating that the emergency vehicle 800 is on emergency duty, and in response, the vehicle positioning unit 41 starts determining the position of the emergency vehicle 800, and the navigation unit 42 plots the route to the preset destination. When the emergency vehicle 800 approaches one of the intersections 700 that is installed with one of the plurality of sets 3 of the traffic light apparatuses, the processing unit 44 determines whether the movement which the emergency vehicle 800 intends to make is in compliance with the route plotted by the navigation unit 42. Afterward, the processing unit 44 generates the direction signal.

In various embodiments, when the distance between the position of the emergency vehicle 800 and the one of the intersections 700 is smaller than a predetermined threshold or when the estimated time of arrival is shorter than a predetermined threshold, the processing unit 44 transmits the direction signal to the corresponding one of the controllers 33 disposed at the one of the intersections 700 the emergency vehicle 800 is approaching. In response, the controller 33 controls the corresponding first traffic light apparatus 31 to display the one of the direction patterns 330, and controls each of the corresponding second traffic light apparatuses 32 to display a correspondingly oriented version of the one of the direction patterns 333, so as to notify other vehicles and pedestrians passing through the intersection 700 about the movement of the emergency vehicle 800.

In one embodiment, the control host 4 is disposed on the emergency vehicle 800.

In some embodiments, the yellow lighting devices 311, 321 used for displaying the yellow traffic signal may be rotatable. For example, at the intersection 700 as shown in FIG. 1, the yellow lighting device 321 of the second traffic light apparatus 32 on the right side may be rotated clockwise by 90 degrees, the yellow lighting device 321 of the second traffic light apparatus 32 on the left side may be rotated counterclockwise by 90 degrees, and the yellow lighting device 321 of the second traffic light apparatus 32 on the opposite side from the first traffic light apparatus 31 may be rotated counterclockwise by 180 degrees. In this configuration, the direction pattern 330 may be directly displayed by each of the second traffic light apparatuses 32 without additional changes in orientation.

Figure 7:
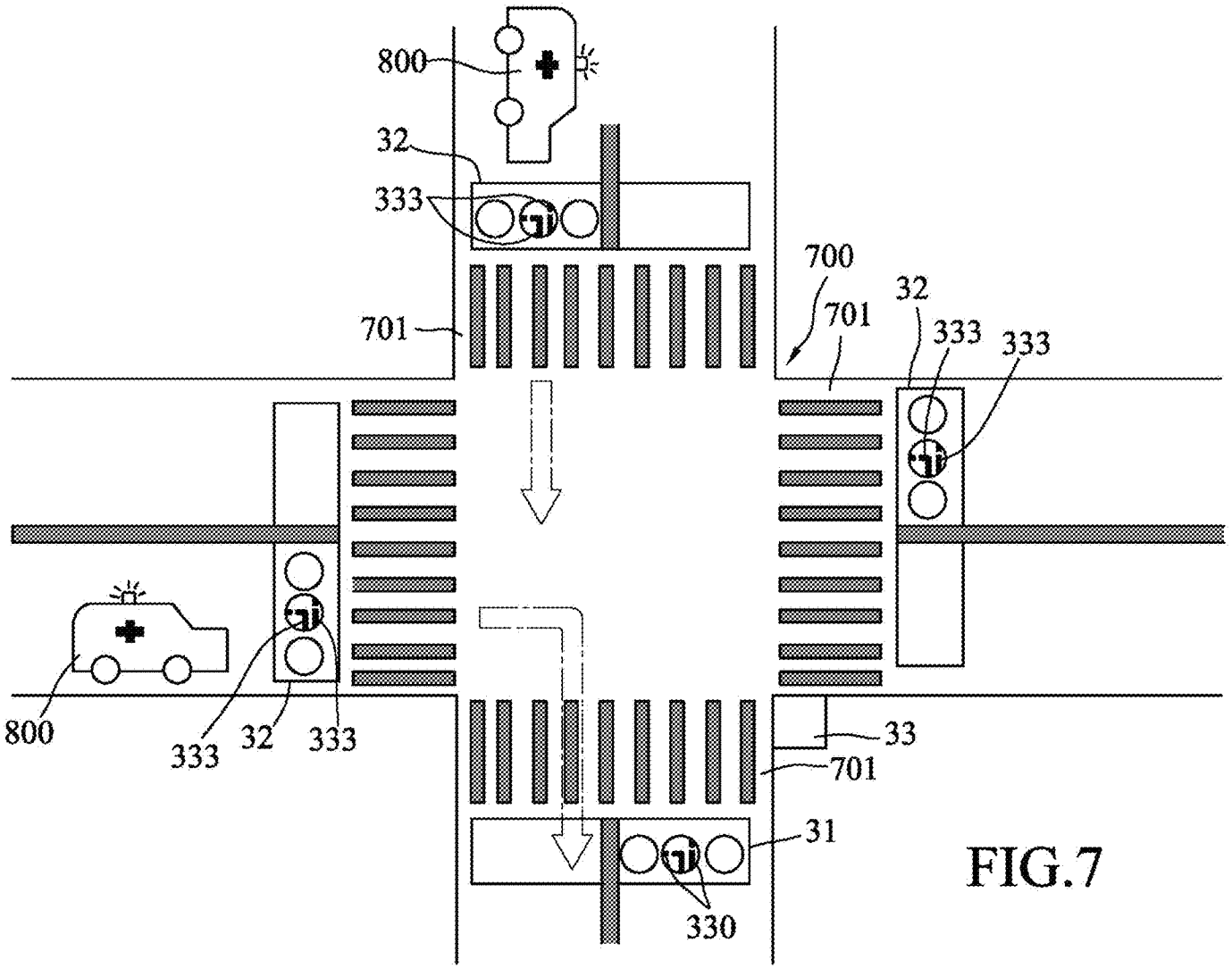
FIG. 7 illustrates the traffic light control system displaying two exemplary direction patterns each directing one of two emergency vehicles to go in separate directions.

In one embodiment as illustrated in FIG. 7, the yellow lighting device 311, 321 used for displaying the yellow traffic signal may be configured to display more than one distinct direction pattern 330. In this configuration, when two or more emergency vehicles 800 are to pass through the intersection 700, each of the set 3 of traffic light apparatuses of the traffic light control system is capable of displaying two or more direction patterns 330 corresponding respectively with the emergency vehicles 800.

In some embodiments, the processing unit 44 is programmed to, when it is determined that the emergency vehicle 800 is making a movement not in compliance with the route, generate the direction signal based on the movement of the emergency vehicle 800. Also, the processing unit 44 is further programmed to determine, after the emergency vehicle 800 has passed the intersection 700, whether the emergency vehicle 800 is moving on the route. The processing unit 44 is programmed to, when it is determined that the emergency vehicle 800 is not moving on the route, detect a moving direction of the emergency vehicle 800 and control the navigation unit 42 to re-plot a route based on the moving direction of the emergency vehicle 800.

To sum up, embodiments of the disclosure provide a traffic light control system that utilizes the yellow lighting devices 311, 321 for displaying the direction pattern 330 and the specifically oriented direction patterns 333 that are generated based on the locations of the second traffic light apparatuses 32 with respect to the corresponding first traffic light apparatus 31. In this configuration, when the emergency vehicle 800 approaches the intersection 700, other vehicles and pedestrians on each of the road segments 701 of the intersection 700 may be notified of the direction the emergency vehicle 800 intends to take, and therefore may be able to appropriately react before the emergency vehicle 800 arrives at the intersection 700. Moreover, since only the yellow lighting devices 311, 321 are involved in displaying the direction patterns 330, 333, the normal functions of the traffic light apparatuses 31, 32 are not affected.

Additionally, the embodiments of the disclosure provide a processing unit 44 that operates with a route detecting unit 43 to determine whether the emergency vehicle 800 is moving in compliance with a pre-plotted route. The processing unit 44 is programmed to, when it is determined that the emergency vehicle 800 is not moving on the route, detect a moving direction of the emergency vehicle 800 and control the navigation unit 42 to re-plot a route based on the moving direction of the emergency vehicle 800.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A traffic light control system comprising:

a set of traffic light apparatuses to be mounted respectively at a plurality of road segments of an intersection, and including a first traffic light apparatus and a plurality of second traffic light apparatuses, each of said traffic light apparatuses for displaying a direction pattern to indicate a direction an emergency vehicle about to pass through the intersection is to move; and a controller coupled to said first traffic light apparatus and said second traffic light apparatuses and storing a number of direction patterns, each of the direction patterns indicating a direction to take and a specific movement manner of the emergency vehicle, the specific movement manner being one of going straight, taking a turn and taking a u-turn;

wherein said controller is programmed to, in response to receipt of a direction signal corresponding to one of the direction patterns, control said first traffic light apparatus to display said one of the direction patterns in a dynamic manner, and control each of said second traffic light apparatuses to display a correspondingly oriented version of said one of the direction patterns in a dynamic manner based on a location of each of said second traffic light apparatuses relative to said first traffic light apparatus.

2. The traffic light control system of claim 1, wherein said controller includes:

a communication unit for receiving the direction signal;

an identification unit programmed to process the direction signal and to identify said one of the direction patterns;

an orientation unit programmed to determine the location of each of said second traffic light apparatuses relative to said first traffic light apparatus, and to generate a plurality of specifically oriented direction patterns respectively for said second traffic light apparatuses by turnings aid one of the direction patterns based on the locations of said second traffic light apparatuses; and a display control unit for controlling said communication unit to transmit said one of the direction patterns to said first traffic light apparatus, and to transmit the specifically oriented direction patterns to said second traffic light apparatuses, respectively;

wherein each of said first traffic light apparatus and said second traffic light apparatuses is configured to, in response to receipt of said one of the direction patterns and the specific oriented direction patterns, respectively, display said one of the direction patterns and the specific oriented direction patterns in the dynamic manner.

3. The traffic light control system of claim 2, wherein:

each of the direction patterns include a line segment that extends along the direction to take;

each of said traffic light apparatuses is programmed to display the direction pattern in the dynamic manner such that the direction pattern is seen as moving along the direction to take repeatedly.

4. The traffic light control system of claim 2, wherein each of said traffic light apparatuses includes a lighting device for displaying the direction pattern.

5. The traffic light control system of claim 2, the intersection being a 4-way intersection having four road segments, wherein in generating the oriented direction patterns:

for one of said second traffic light apparatuses that is on a right side of said first traffic light apparatus, the oriented direction pattern is generated by turning said one of the direction patterns clockwise by 90 degrees; and for one of said second traffic light apparatuses that is on a left side of said first traffic light apparatus, the oriented direction pattern is generated by turning said one of the direction patterns counterclockwise by 90 degrees.

6. The traffic light control system of claim 2, further comprising a control host that includes:

a vehicle positioning unit for determining a position of the emergency vehicle; and a processing unit for determining a distance between the position of the emergency vehicle and the intersection.

7. The traffic light control system of claim 6, wherein, said processing unit is programmed to, when said processing unit determines that the distance between the position of the emergency vehicle and the intersection is shorter than a predetermined threshold, generate the direction signal based on the position of the emergency vehicle and transmit the direction signal to said controller.

8. The traffic light control system of claim 7, further comprising:

a plurality of sets of said traffic light apparatuses, each of said sets of said traffic light apparatuses to be mounted at a corresponding intersection; and a plurality of said controllers coupled respectively to the sets of said traffic light apparatuses.

9. The traffic light control system of claim 6, wherein:

said processing unit is programmed to obtain the position of the emergency vehicle periodically so as to calculate a moving speed of the emergency vehicle, and to calculate an estimated time of arrival based on the moving speed of the emergency vehicle and the distance between the position of the emergency vehicle and the intersection;

said processing unit is programmed to, when it is determined that the estimated time of arrival is shorter than a predetermined threshold, generate the direction signal based on the position of the emergency vehicle and transmit the direction signal to said controller.

10. The traffic light control system of claim 6, wherein:

said control host further includes a navigation unit for plotting a route from the position of the emergency vehicle to a preset destination through the intersection, and to determine the direction to take when the emergency vehicle passes through the intersection based on the route; and in generating the direction signal, said processing unit incorporates the direction to take in the direction signal.

11. The traffic light control system of claim 10, wherein:

said processing unit is further programmed to:

determine, after the emergency vehicle has passed the intersection, whether the emergency vehicle is moving on the route;

when it is determined that the emergency vehicle is not moving on the route, detect a moving direction of the emergency vehicle; and control said navigation unit to re-plot a route based on the moving direction of the emergency vehicle.

12. The traffic light control system of claim 11, wherein:

said control host further includes a route detecting unit for receiving a turning signal from the emergency vehicle;

said processing unit is programmed to, in response to receipt of the turning signal, when it is determined that the emergency vehicle is taking a movement not in compliance with the route, generate the direction signal based on the movement of the emergency vehicle.

* * * * *